US005704090A

United States Patent [19]

Berfield

[11] Patent Number: 5,704,090

[45] Date of Patent: Jan. 6, 1998

[54] BLEED FOR A VACUUM CLEANER

[75] Inventor: Robert C. Berfield, Jersey Shore, Pa.

[73] Assignee: Shop Vac Corporation, Williamsport, Pa.

[21] Appl. No.: 525,414

[22] Filed: Sep. 8, 1995

[51] Int. Cl.[6] ..... A47L 5/32

[52] U.S. Cl. ..... 15/339; 15/375; 15/421; 251/286

[58] Field of Search ..... 15/375, 376, 421, 15/339; 251/285, 286

[56] References Cited

U.S. PATENT DOCUMENTS

| | | |
|---|---|---|
| 953,825 | 4/1910 | Gekeler . |
| 1,106,231 | 8/1914 | Marshall . |
| 2,631,326 | 3/1953 | Smith, Jr. . |
| 2,747,944 | 5/1956 | Baermann . |
| 2,978,733 | 4/1961 | Wahlborg . |
| 3,142,857 | 8/1964 | Fresard et al. . |
| 3,335,727 | 8/1967 | Spoto . |
| 3,633,239 | 1/1972 | Meyerhoefer . |
| 4,275,474 | 6/1981 | Woodard . |
| 4,961,245 | 10/1990 | Barnes, Jr. et al. . |
| 5,050,266 | 9/1991 | Schneider . |

FOREIGN PATENT DOCUMENTS

| | | |
|---|---|---|
| 137078 | 5/1950 | Australia . |
| 28 15 196 | 10/1979 | Germany . |
| 674845 | 7/1952 | United Kingdom . |

OTHER PUBLICATIONS

Drawing of Hoover "Automatic Power Drive Dial-a--Matic"—Figure 1.

Drawing of Hoover "Automatic Power Drive Dial-a--Matic"—Figure 2.

*Primary Examiner*—Chris K. Moore

*Attorney, Agent, or Firm*—Marshall, O'Toole, Gerstein, Murray & Borun

[57] ABSTRACT

A vacuum cleaner attachment for use in a suction line comprises a bleed section having an aperture extending into an interior portion of the attachment and a collar disposed in the bleed section. The collar is positionable in only a finite number of stable orientations wherein the collar covers the aperture in a first orientation and exposes the aperture in a second orientation.

12 Claims, 2 Drawing Sheets

BLEED FOR A VACUUM CLEANER

TECHNICAL FIELD

The present invention relates generally to vacuum cleaners, and more particularly to an improved bleed for a vacuum cleaner attachment.

BACKGROUND ART

Vacuum cleaners typically include a floor standing tank having a motor/blower combination therein to produce suction at an inlet port. A suction line extends from the inlet port and typically includes a flexible hose and optional equipment attached to the hose including a handle, an elongate wand, and a cleaning nozzle.

It is desirable in any vacuum cleaner arrangement to control the amount of suction applied to the surface to be cleaned without having to vary the suction produced by the motor/blower combination. Accordingly, vacuum cleaners commonly provide the operator with the option of exposing a bleed hole located at some point along the suction line.

U.S. Pat. No. 3,633,239 discloses an adjustable bleed for a vacuum cleaner disposed on a wall of a floor standing tank having a series of slide valves for selectively covering or exposing one or more apertures in a wall of the floor standing tank. Each valve includes a valve element including an aperture therethrough and a push button which enables the operator to push the valve element along a path to align the aperture of the valve element with one of the apertures in the wall. The nature of the push button assembly provides for an adjustable, yet stable selection of a suction level.

U.S. Pat. No. 4,961,245 discloses an adjustable bleed for a vacuum cleaner conveniently located on a handle for an elongate wand. The handle includes a rotatable collar partially encircling a bleed section having an aperture. In such a design, the collar is circumferentially movable to expose part or all of the aperture. However, the collar is freely movable but for the friction between it and the handle. As a result, minor, unintended applications of force to the collar can cause modifications in bleed hole exposure and, therefore, suction level.

The Hoover "Automatic Power Drive Dial-A-Matic" vacuum cleaner includes a handle having a bleed section partially surrounded by a collar movable to one of three stable orientations exposing a bleed hole in the bleed section or partially or fully covering the bleed hole. The three stable orientations are created by the engagement of a projection on the handle with one of three grooves formed on an inner surface of the collar. In addition, a radially inwardly directed flange is formed on one end of the collar and engages a wall defining one end of the aperture to limit circumferential movement of the collar beyond a particular point. While the projection and groove design provides limited stability when appropriately engaged, the design provides no stability when the collar is disposed between such relatively stable orientations. Moreover, the Hoover Dial-A-Matic provides only limited stability because minor applications of force can disengage the projection and groove, and therefore rotate the collar to an unintended orientation.

SUMMARY OF THE INVENTION

According to one aspect of the present invention, a vacuum cleaner attachment for use in a suction line comprises a bleed section having an aperture extending into an interior portion of the attachment and a collar disposed in the bleed section that is positionable in only a finite number of stable orientations wherein the collar either covers the aperture in a first orientation or exposes the aperture in a second orientation.

In a preferred embodiment, the bleed section has a second aperture extending into the interior portion of the attachment. The collar may then be disposed in a third stable orientation exposing the second aperture. The collar may also be disposed in a fourth stable orientation covering both the first and second apertures. If the first aperture and second aperture differ in size, each orientation offers the operator a level of suction dependent upon which one of the apertures is exposed, if any.

According to another aspect of the present invention, a vacuum cleaner attachment having a longitudinal central axis comprises a bleed section having an outer surface of non-circular cross section including a plurality of sides each separated from adjacent sides by corner portions and wherein an aperture is disposed in one side and extends into an interior portion of the attachment and a resilient collar disposed in the bleed section having an inner surface closely conforming to the outer surface of the bleed section. The collar is deformable to permit rotation thereof about the longitudinal central axis between a first orientation exposing the aperture and a second orientation covering the aperture.

According to still another aspect of the present invention, a vacuum cleaner attachment having a longitudinal central axis comprises a bleed section including a base wall which is symmetric in cross section about the longitudinal central axis and comprising first through fourth sides separated from one another by first through fourth corner portions. The bleed section further includes first and second axially spaced circumferential walls disposed on first and second ends of the base wall. An aperture is disposed on one of the first through fourth sides and extends into an interior portion of the attachment. A C-shaped collar is disposed about and embraces the base wall between the axially spaced side walls, and includes three legs that substantially conform to each of the sides of the base wall. The collar is rotatable to four stable orientations including a first stable orientation wherein the collar exposes the aperture and second through fourth orientations wherein the collar covers the aperture.

The present invention provides a user with the ability to select and maintain a desired, constant vacuum level at the suction line outlet in a positive fashion without unintended variations caused by inadvertent forces acting at the bleed section.

DESCRIPTION OF THE PREFERRED EMBODIMENT

Figure 1:
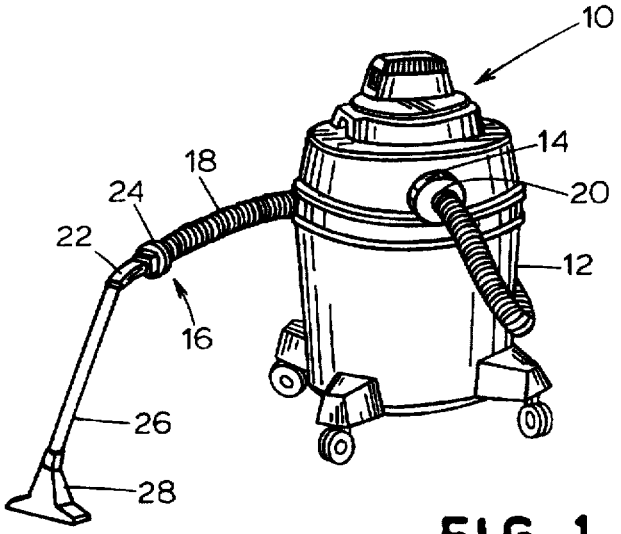
FIG. 1 is a perspective view of a vacuum cleaner in which the present invention may be used.

Referring to FIG. 1, a vacuum cleaner 10 in which the present invention may be used comprises a floor standing tank 12 having a motor/blower combination therein (not shown) for providing suction at an inlet port 14, to which a suction line 16 is attached. The suction line 16 includes a flexible hose 18 and one or more further optional attachments. For example, as seen in FIG. 1, a first end 20 of the flexible hose 18 is connected to the inlet port 14. An elbow attachment 22 links a second end 24 of the hose 18 to an elongate wand 26 terminating in a cleaning nozzle 28.

Figure 2:
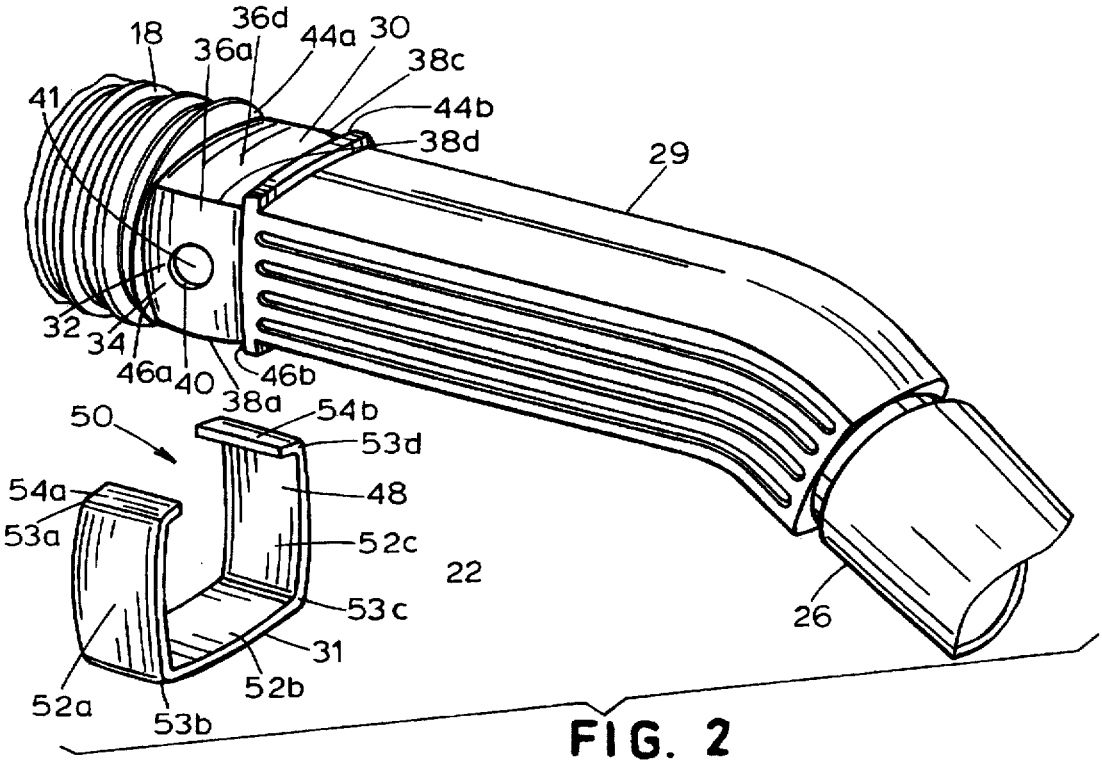
FIG. 2 is an exploded perspective view of the handle of the vacuum cleaner of FIG. 1 having a bleed section and a collar according to the present invention.
Figure 3:
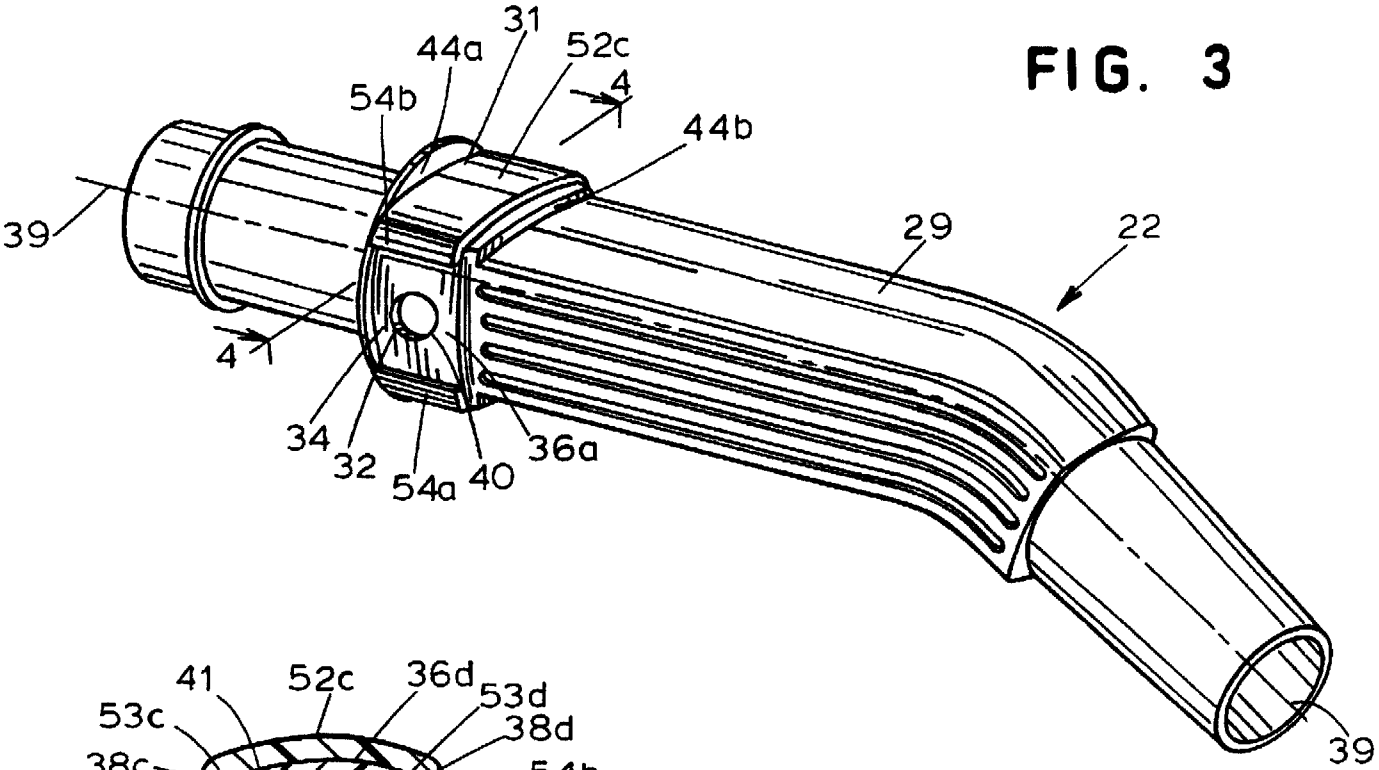
FIG. 3 is a perspective view of the handle of FIG. 2 wherein the collar is disposed in a stable orientation.
Figure 4:
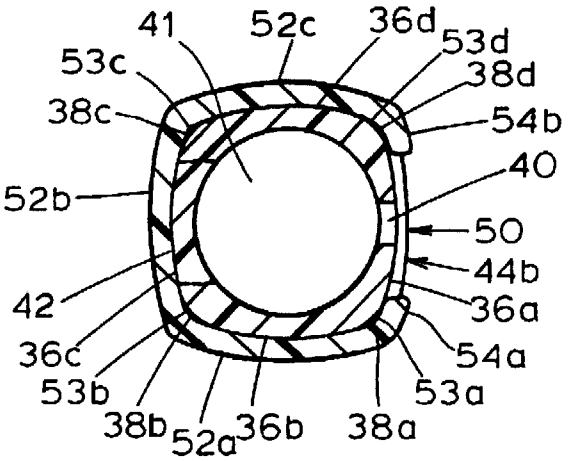
FIG. 4 is a sectional view of the handle taken generally along the lines 4—4 of FIG. 3.

Referring now to FIGS. 2–4, in a preferred embodiment, the elbow attachment 22 includes a handle section 29 and a bleed section 30 having a resilient collar 31 disposed therein. The bleed section 30 has an outer surface 32 of non-circular cross section defined by a base wall 34 having a plurality of sides 36 separated from one another by corner portions 38. Each side 36 and corner portion 38 has a respective curvature as shown, and the outer surface 32 of the base wall 34 is preferably, although not necessarily, symmetric about a longitudinal central axis 39 of the elbow attachment 22. As shown, the base wall 34 preferably has four sides **36*a*–36*d* separated from one another by four corner portions 38*a*–38*d* wherein one side 36*a* has an aperture 40 disposed therein. The aperture 40 extends into an interior portion 41 of the elbow attachment 22. Further, as noted by the dashed lines in FIG. 4, the bleed section 30 can have one or more optional additional apertures disposed in one or more sides 36, such as the aperture 42 disposed in the side 36*c* and also extending into the interior portion 41 of the elbow attachment 22. Each additional aperture, such as the aperture 42, can be larger or smaller than the aperture 40 or may be the same size as the aperture 40**.

Referring specifically to FIG. 3, the resilient collar 31 is disposed between a pair of axially spaced side walls **44*a* and 44*b* located at first and second ends 46*a* and 46*b* of the base wall 34. The axially spaced side walls 44*a* and 44*b* may be different in shape or size as shown. Referring also to FIG. 4, the collar 31 has a cross-sectional inner surface 48 closely conforming to the outer surface 32 of the bleed section 30. The resilient collar 31 does not fully enclose the underlying bleed section 30, leaving a gap 50 that exposes approximately one side 36 of the base wall 34 of the bleed section 30. As shown, the preferred embodiment of the collar 31 has a cross section resembling a C-ring having three legs 52*a*–52*c* joined at corner portions 53*b* and 53*c* wherein each leg 52*a*–52*c* substantially conforms to each of the sides 36 of the base wall 34. First and second optional partial leg sections 54*a* and 54*b* are connected to the legs 52*a* and 52*c* at corner portions 53*a* and 53*d*, respectively and substantially conform to outer portions of each side 36 of the base wall 34. In addition, an inner surface of each corner portion 53*a*–53*d* preferably closely conforms to the outer surfaces of the corner portions 38*a*–38*d***.

The rotational orientation of the collar 31 determines whether an aperture 40 or 42 is exposed or covered. The suction level at the cleaning nozzle 28 can thus be adjusted by rotating the collar 31 to an orientation exposing no aperture, an orientation exposing the aperture 40, or an orientation exposing the aperture 42 if the aperture 42 is included. The suction level will be reduced accordingly as the size of the exposed aperture increases. As noted above, the present invention is by no means limited to bleeds having only one or two apertures, for one need only increase the number of sides 36 of the base wall 34 of the bleed section 30 to accommodate more apertures.

Due to the closely conforming, non-circular cross sections of the inner surface 48 of the collar 31 and the outer surface 32 of the bleed section 30, rotation of the collar 31 requires a force sufficient to elastically deform the collar 31. If the collar 31 is rotated to an orientation in which the corner portions **38*a*–38*d* are not substantially aligned with the corner portions 53*a*–53*d*, the collar 31 will be flexed and placed in tension. The tension in the collar 31 will render such an orientation inherently unstable, causing a rotation to an orientation in which the corner portions 38*a*–38*d* and 53*a*–53*d* are aligned. Consistent therewith, the collar 31** may thus be disposed in only a finite number of stable orientations so that the collar is effectively latched against unintended movement.

For example, referring specifically to FIG. 4, in the preferred embodiment having four sides **36*a*–36*d*, the collar 31 accordingly has four stable orientations. A first stable orientation of the collar 31 is as shown, wherein the smaller aperture 40 is exposed. After rotating the collar 31 clockwise 90° to a second stable orientation, the gap 50 is centered on the side 36*b*, which does not have an aperture. If the collar 31 is rotated to a position between the first and the second orientations, upon release the collar 31 rotates to either the first or second orientation. A third stable orientation is located 90° clockwise from the second orientation (as seen in FIG. 4) such that the gap 50 exposes the larger aperture 42 (if used). A fourth stable orientation is located 90° clockwise from the third orientation thereby exposing the side 36*d*, which does not have an aperture. Again, any attempt to position the collar 31 between stable orientations results in the tendency of the collar 31** to move to one of the adjacent stable orientations.

The present invention is not limited to a bleed located on a handle section 29 or an elbow attachment 22, but rather encompasses a bleed disposed on any attachment along the suction line 16, as desired. Nor is the present invention limited to a bleed section 30 having a base wall 34 shaped as described above. Numerous nonsymmetrical shapes are functionally equivalent provided that the collar 31 prevents loss of vacuum through covered apertures. For example, a collar 31 still substantially (although not completely) conforming to the base wall 34 could have an inner surface 48 with more curvature than the sides 36 of the base 34, or perhaps even include a leg 52 with an inward or outward projection or indentation. Alternatively, one or more sides 36 of the base 34 may not completely conform to the inner surface 48. Enlargement of the axially spaced side walls **44*a* and 44*b* can accommodate for such non-conforming portions of the base wall 34 and the inner surface 48 of the collar 31 and still provide sealing against vacuum loss provided that the side walls 44*a* and 44*b* are sealingly abutted by the edges of the collar 34. In addition, the curvature of the sides 36 and the corner portions 38 can be varied together with the curvature of the collar 31, and the partial leg sections 54*a* and 54*b* may be omitted or changed, as long as the collar 31 is rotatably maintained on the base wall 34** and movable to only a finite number of stable orientations.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which are within the scope of the appended claims, is reserved.

What is claimed is:

1. A vacuum cleaner attachment for use in a suction line, comprising:

a bleed section having a first aperture and a second aperture wherein the first aperture and the second aperture extend into an interior portion of the attachment; and a collar disposed in the bleed section and positionable in only a finite number of stable orientations wherein the collar covers the first aperture in a first orientation, exposes the first aperture in a second orientation, and exposes the second aperture in a third orientation.

2. The vacuum cleaner attachment of claim 1, wherein the first and second apertures differ in size.

3. The vacuum cleaner attachment of claim 1, wherein the collar may be disposed in a fourth stable orientation covering the first and second apertures.

4. A vacuum cleaner attachment having a longitudinal central axis and adapted for use in a suction line, comprising:

a bleed section having an outer surface of non-circular cross section including a plurality of sides each separated from adjacent sides by corner portions and wherein an aperture is disposed in one side and extending into an interior portion of the attachment; and a resilient collar disposed in the bleed section having an inner surface closely conforming to the outer surface of the bleed section, wherein the collar is deformable to permit rotation thereof about the longitudinal central axis of the attachment between a first orientation exposing the aperture and a second orientation covering the aperture.

5. The vacuum cleaner attachment of claim 4, wherein the bleed section has at least four sides and at least four corner portions.

6. The vacuum cleaner wand of claim 5, wherein the outer surface of the bleed section further includes a second aperture disposed in another side and extending into an interior portion of the attachment wherein the collar can assume a third orientation exposing the second aperture.

7. The vacuum cleaner attachment of claim 6, wherein the first and second apertures differ in size.

8. The vacuum cleaner attachment of claim 7, wherein the collar can assume a fourth orientation covering the first and second apertures.

9. A vacuum cleaner attachment having a longitudinal central axis and adapted for use in a suction line, comprising:

a bleed section including a base wall which is symmetric in cross section about the longitudinal central axis and comprising first through fourth sides separated from one another by first through fourth corner portions, wherein the bleed section further includes first and second axially spaced side walls disposed on first and second ends of the base wall;

an aperture disposed on one of the first through fourth sides and extending into an interior portion of the attachment; and a C-shaped collar disposed about and embracing the base wall between the axially spaced side walls and having three legs each of which substantially conforms to each of the first through fourth sides wherein the collar is rotatable to first through fourth stable orientations and wherein the collar exposes the aperture in the first stable orientation and covers the aperture in the second through fourth stable orientations.

10. The vacuum cleaner attachment of claim 9, wherein the C-shaped collar further includes first and second partial leg portions substantially conforming to the first through fourth corner portions.

11. The vacuum cleaner attachment of claim 9, wherein the bleed section further includes a second aperture disposed on a second side and extending into the interior portion of the attachment and wherein the collar may be disposed in a third stable orientation exposing the second aperture.

12. The vacuum cleaner attachment of claim 11, wherein the first and second apertures differ in size.

* * * * *